US009018802B2

(12) United States Patent
Sun et al.

(10) Patent No.: US 9,018,802 B2
(45) Date of Patent: Apr. 28, 2015

(54) PULSED POWER SUPPLY FOR PLASMA ELECTROLYTIC DEPOSITION AND OTHER PROCESSES

(75) Inventors: Jian Sun, Richmond (CA); Weiman Qian, Vancouver (CA); Wei Qu, Vancouver (CA); Shiqiang Hui, Vancouver (CA)

(73) Assignee: National Research Council of Canada, Ottawa, ON (CA)

( * ) Notice: Subject to any disclaimer, the term of this patent is extended or adjusted under 35 U.S.C. 154(b) by 762 days.

(21) Appl. No.: 13/382,679

(22) PCT Filed: Jul. 6, 2010

(86) PCT No.: PCT/CA2010/000987

§ 371 (c)(1),
(2), (4) Date: Jan. 6, 2012

(87) PCT Pub. No.: WO2011/003178

PCT Pub. Date: Jan. 13, 2011

(65) Prior Publication Data

US 2012/0119591 A1 May 17, 2012

Related U.S. Application Data

(60) Provisional application No. 61/213,763, filed on Jul. 10, 2009.

(51) Int. Cl.

| | |
|---|---|
| ***H03K 3/00*** | (2006.01) |
| ***C25D 11/00*** | (2006.01) |
| ***C25D 11/02*** | (2006.01) |

(52) U.S. Cl.

CPC ..... *C25D 11/00* (2013.01); *C25D 11/026* (2013.01)

(58) Field of Classification Search

USPC ..... 307/106

See application file for complete search history.

(56) References Cited

U.S. PATENT DOCUMENTS

| | | | |
|---|---|---|---|
| 3,832,293 | A | 8/1974 | Hradcovsky et al. |
| 4,082,626 | A | 4/1978 | Hradcovsky |

(Continued)

FOREIGN PATENT DOCUMENTS

| | | |
|---|---|---|
| CN | 201242667 | 5/2009 |

OTHER PUBLICATIONS

English abstract of CN 201242667; May 20, 2009; Beijing MPT Heat Treat Technol (CN).

(Continued)

*Primary Examiner* — Jared Fureman
*Assistant Examiner* — Duc M Pham
(74) *Attorney, Agent, or Firm* — Jason E.J. Davis

(57) ABSTRACT

The invention disclosed is a pulsed power supply for plasma electrolytic deposition (PED) for generating pulsed direct current for controlled interruption of the arcing process of PED, comprising a power distribution and relay logic (PDRL) module; a positive AC/DC (alternating current/direct current) power module; a negative AC/DC power module; a power pulse output module; and a computer control and data acquisition module, wherein the power pulse output module further comprises a pulse controller and an insulated-gate bipolar transistor (IGBT) power switch, and wherein the PDRL module is operatively coupled to both the positive and negative AC/DC power modules and the respective positive and negative power modules are then operatively coupled to both the power pulse output module and the computer control and data acquisition module, and wherein the computer control and data acquisition module controls both the respective positive and negative power modules and the power pulse output module to generate pulsed DC for controlled interruption of the arcing process.

7 Claims, 9 Drawing Sheets

(56) References Cited

U.S. PATENT DOCUMENTS

| | | | | |
|---|---|---|---|---|
| 4,478,689 | A | 10/1984 | Loch | |
| 4,517,059 | A | 5/1985 | Loch et al. | |
| 5,049,246 | A | 9/1991 | Hull et al. | |
| 5,914,022 | A | 6/1999 | Lowry et al. | |
| 6,179,984 | B1 | 1/2001 | Maurer | |
| 6,197,178 | B1 | 3/2001 | Patel et al. | |
| 6,666,960 | B2 * | 12/2003 | Arai et al. | 204/230.2 |
| 6,806,613 | B2 | 10/2004 | Ebihara et al. | |
| 2003/0035305 | A1 * | 2/2003 | Arai et al. | 363/17 |
| 2003/0094377 | A1 | 5/2003 | Krishna et al. | |
| 2003/0188972 | A1 | 10/2003 | Shatrov et al. | |
| 2004/0238368 | A1 | 12/2004 | Mawston | |

OTHER PUBLICATIONS http://en.wikipedia.org/wiki/IGBT.

Li et al., "Application of 2SD315A in the Power Supply of Micro-Arc Oxidation", Electric Welding Machine, vol. 36(12), p. 39-42, 2006.

Li et al., "Application of 2SD315A in the Power Supply of Micro-Arc Oxidation", Electric Welding Machine, vol. 36(12), p. 39-42, 2006, English Abstract.

Nakagawa et al., "Safe Operating Area for 1200-v Non-Latch-Up Bipolar-Mode MOSFETs", IEEE Trans. on Electron Devices, ED-34, p. 351-355, 1987.

* cited by examiner

PULSED POWER SUPPLY FOR PLASMA ELECTROLYTIC DEPOSITION AND OTHER PROCESSES

FIELD OF THE INVENTION

This application is a national entry of International Patent Application PCT/CA2010/000987 filed Jul. 6, 2010 and claims benefit of U.S. Provisional Patent Application Ser. No. 61/213,763 filed Jul. 10, 2009, the entire contents of which is herein incorporated by reference.

This invention relates to a pulsed power supply for plasma electrolytic deposition (PED) and like processes.

BACKGROUND OF THE INVENTION

Plasma electrolytic deposition (PED) is a process for electrolytically coating a conductive (metal) surface with a hard, glassy, corrosion-resistant protective layer such as a ceramic coating. The coating property and quality of the process is determined by many factors such as composition and concentration of the electrolytes, applied electrical voltage, current density and duration. Different names have been used for PED in the literature, including "plasma electrolytic oxidation (PEO)", "plasma electrolytic saturation (PES)", "plasma electrolytic nitriding/carburizing (PEN/PEC)", "microarc oxidation (MAO)" or "spark anodizing". A key feature of the process that differs from anodizing is the occurrence of plasma discharging at the metal-coating interface when employing high potentials. When the applied potential exceeds a certain critical breakdown point, a number of discrete short-lived microdischarges will appear and will be moving across the metal surface to form a surface film. This process can be used to grow ceramic coatings on metal substrate. The thickness of the surface coating could be in a range from tens of micrometers to hundreds of micrometers. Because these surface coatings can provide high hardness and a continuous barrier, they can offer protection against wear, corrosion or heat as well as electrical insulation.

The surface coating generated by this technique is actually a chemical conversion of the substrate metal into its oxide. During the microarcing process, the oxides grow both inwards and outwards from the original metal surface. Because of this conversion process, the coatings have strong adhesion to the substrate metal, comparing to conventional deposited coatings. A wide range of metal substrates can be coated, including aluminum alloys, zircoalloys, titanium alloys, magnesium alloys, and most cast alloys.

Through adjusting electrolyte composition, the metal surface can be saturated by the non-metallic elements such as O, C, N, B and the combination of these. These elements can form a vapor envelop along the metallic substrate surface and diffuse inward to the metal in a PED process. The diffusant species are the chemicals that can be negatively ionized in the electrolyte. The plasma will vaporize these species to form a vapor envelope. The electric field applied by PED will accelerate across the voltage drop to bombard the substrate surface through interstitial and grain-boundary diffusion. It was reported that PED could be used for nitriding, carburizing, boriding, carbonitriding and etc.

Another unique feature of PED is it can reach a temperature as high as 2×104° C. by a plasma thermo-chemical reaction in a time period of less than 10-6 s and then cooling down rapidly at a rate of 108 K/s. This feature enables PED to form some special surface structures such as metastable high temperature phases, nonequilibrium solid solutions, complex mixed-compounds, glassy glasses, etc. These special structures can be designed for anti-corrosion coating, super-hard surface protective coating, wear resistance coating, heat-protective coating, etc.

The prior art includes the following:

U.S. Pat. No. 6,806,613 discloses a process for plasma microarc oxidation for producing ceramic coatings on metal workpieces having semiconducting properties. Refer to FIG. 2. A current generator is disclosed that includes: a module for converting a sinusoidal AC periodic signal into a triangular or trapezoidal signal, the converting module having a power supply input; a module for modifying the slope and form factor of the voltage signal; a module to control variation in frequency; a module to control electrical energy to the DC output; and a micro-computer for managing the electrical energy. The voltage generator is connected to the anode immersed in an electrolytic bath.

U.S. Pat. No. 6,666,960 discloses an electroplating current supply system that includes a power supply unit for supplying an object to be plated with an electroplating current whose polarity is inverted at predetermined intervals. Refer to FIG. 2. The power supply unit includes a first DC power supply supplying a positive current and a second DC power supply supplying a negative current. These first and second DC power supplies are capable of producing DC power by rectifying commercial AC power. IGBT devices are utilized as high speed switching means and are operatively connected between the output of the respective DC power supplies to the load terminals coupled to the plating load.

The system also includes a processing unit for controlling the ratio in magnitude and duration of the positive current to the negative current supplied to the object so as to ensure uniform coating. A display device is connected to the processing unit to notify the operator that the circuit including the plating load has been opened (a safety feature for the operator).

U.S. Pat. Nos. 4,478,689; 4,517,059 (same assignee and disclosure) is an automated process for electrolytic processing of a metal surface, preferably by anodization. Of relevance, the process discloses the use of pre-programmable and computerized process. Specifically, a microprocessor for electronically monitoring voltages is disclosed. Refer to FIG. 3.

U.S. Pat. No. 5,049,246 is an apparatus for electrolytic processing such as electroplating is disclosed. A power supply for supplying time multiplexed power to electrodes is disclosed. The power supply may include a pulse width modulator or pulse position modulator and is operative to control the relative amounts of time that the respective electrodes are energized for electroplating.

Also the website http://en.wikipedia.orq/wiki/IGBT discloses a suggestion of using an IGBT with PWM modulation in medium and high power supplies. The relevant portions of the publication disclose the following: "The Insulated gate bipolar transistor or IGBT is a three-terminal power semiconductor device, noted for high efficiency and fast switching. It switches electric power in many modern appliances: electric cars, variable speed refrigerators, air-conditioners, and even stereo systems with digital amplifiers. Since it is designed to rapidly turn on and off, amplifiers that use it often synthesize complex waveforms with pulse width modulation and low-pass filters. The IGBT combines the simple gate-drive characteristics of the MOSFETs with the high-current and low-saturation-voltage capability of bipolar transistors by combining an isolated gate FET for the control input, and a bipolar power transistor as a switch, in a single device. The IGBT is used in medium- to high-power applications such as switched-mode power supply, traction motor control and induction heating" It is emphasized that the reference does not disclose the use of a power supply for electrolytic purposes having an integrated computer control module for controlled interruption of the PED arcing process. In fact the reference merely suggests that a power supply might utilize IGBTs and that IGBTs may be utilized in coordination with pulse width modulators. There is no suggestion here of how to manage such a power supply using an integrated control module or a further suggestion that the control module would provide for controlled interruption of a PED-like process.

SUMMARY OF THE INVENTION

In order to achieve all the advantages of PED, a high power electrical source is required. A normal DC source allows the application of galvanostatic or potentiostatic regimes of direct current, which is difficult to use to regulate the surface discharging. The desired PED power source should have the capability to generate pulsed DC for acquiring controlled interruption of the process and the arc duration and capability to avoid additional polarization of the electrode. Furthermore, it would be useful to have the function to alternate current with different amplitudes to the positive and negative components, which make it possible to control the coating microstructure.

According to the invention, in order to accommodate the largely varied requirements from different coating processes, a power unit with an integrated control interface is required. In general, the power unit should have a series of controllable features in terms of frequency, polarity, limits of voltage and current, flexibility of output pulse waveform, and safety. Currently, there is no such a product available on the market.

The present invention provides a power source that is able to generate pulsed DC for controlled interruption of the arcing process of PED. The power supply of the present invention comprises five (5) modules:

(i) a power distribution and relay logic (PDRL) module;
(ii) a positive AC/DC (alternating current/direct current) power module;
(iii) a negative AC/DC power module;
(iv) a power pulse output module; and
(v) a computer control and data acquisition module.

The PDRL module is operatively coupled to both the positive and the negative AC/DC power modules, respectively. These respective positive and negative power modules are then operatively coupled to both the power pulse output module and the computer control and data acquisition module. The power pulse output module further comprises a pulse controller and an insulated-gate bipolar transistor (IGBT) power switch.

In operation, the PDRL module receives, at its AC input, a 208 volt AC three-phase supply. The positive AC/DC power module converts the AC pulses received from the PDRL into negative DC pulses ranging from 0 to 800 volts direct current (VDC). Similarly, the positive AC/DC power module converts the AC pulses received from the PDRL into negative DC pulses ranging from 0 to 200 volts direct current (VDC). The pulse controller then enables the IGBT device to switch between outputting positive and negative DC pulses to the power pulse output module. The power pulse output module is operatively connected to the electrodes in contact with the bodies to be coated. The computer control and data acquisition module controls both the respective positive and negative power modules and the power pulse output module to generate pulsed DC for controlled interruption of the arcing process.

The present invention has a number of advantages over the prior art mentioned above. Firstly, the computer control and data acquisition module is embodied in a microcontroller (e.g., TI C2000 microcontroller) that provides control over power supply features such as frequency, polarity, limits of voltage and current, flexibility of output pulse waveform, and safety. Also advantageous is the present invention's capability to provide a high power pulsed DC source for controlled interruption of the arcing process to avoid additional polarization of the electrode. Additionally, the ability to alternate current with different amplitudes to positive and negative components provides better control of the coating microstructure over the prior art devices.

As well, the power pulse output module of the present invention utilizes pulse width modulation (PWM) with the IGBT device to switch at a broader range of frequencies (30-6000 Hz) than the traditional industry range of frequencies of 50 Hz or 60 Hz. This higher frequency results in greater efficiencies in the PED process. The broader range of frequencies provides more controllable microstructure of the coatings which determines the performance of the coatings.

According to one aspect of the present invention, we provide a pulsed power supply for plasma electrolytic deposition (PED), comprising a power distribution and relay logic (PDRL) module;

a positive AC/DC (alternating current/direct current) power module;

a negative AC/DC power module;

a power pulse output module; and a computer control and data acquisition module, wherein the power pulse output module further comprises a pulse controller and an insulated-gate bipolar transistor (IGBT) power switch, and wherein the PDRL module is operatively coupled to both the positive and negative AC/DC power modules and the respective positive and negative power modules are then operatively coupled to both the power pulse output module and the computer control and data acquisition module, and wherein the computer control and data acquisition module controls both the respective positive and negative power modules and the power pulse output module to generate pulsed DC for controlled interruption of the arcing process.

In an embodiment of this aspect of the invention, the computer control and data acquisition module is embodied in a microcontroller (e.g., TI C2000 microcontroller) that provides control over power supply features such as frequency, polarity, limits of voltage and current, flexibility of output pulse waveform, and safety.

In an embodiment of this aspect of the invention, the positive AC/DC power module converts AC pulses received from the PDRL into positive DC pulses ranging from 0 to 800 volts direct current (VDC).

In an embodiment of this aspect of the invention, the positive AC/DC power module converts the AC pulses received from the PDRL into negative DC pulses ranging from 0 to 200 volts direct current (VDC).

In an embodiment of this aspect of the invention, the pulse controller then enables the IGBT device to switch between outputting positive and negative DC pulses to the power pulse output module.

In an embodiment of the invention, the power pulse output module utilizes pulse width modulation (PWM) with the IGBT device to switch the supply pulses at setup frequencies (of 30-6000 Hz).

While the individual elements (modules) of the present invention are disclosed in the aforementioned prior art or form part of the common general knowledge of a person of skill in the art, the combination of these elements for PED neither disclosed nor suggested. Furthermore, there is no single reference that discloses every element of the invention. Moreover, none of the prior art references show or teach a high power supply that generates pulsed DC using pulsed width modulators and insulated gate bipolar transistors and that has an integrated computer control module for controlled interruption of the PED arcing process.

DETAILED DESCRIPTION OF THE INVENTION

The proposed novel pulsed power supply for plasma electrolytic deposition has high efficiency, lower material cost and lower weight compared with the traditional similar power supplies. These novel power units use high frequency Pulse Width Modulation (PWM) AC/DC switch power regulation modules to replace the traditional industrial frequency (50 Hz or 60 Hz) AC/DC power regulation modules and use computer controlled Integrated Gate Bipolar Transistor (IGBT) to obtain the pulsed power output.

Figure 1:
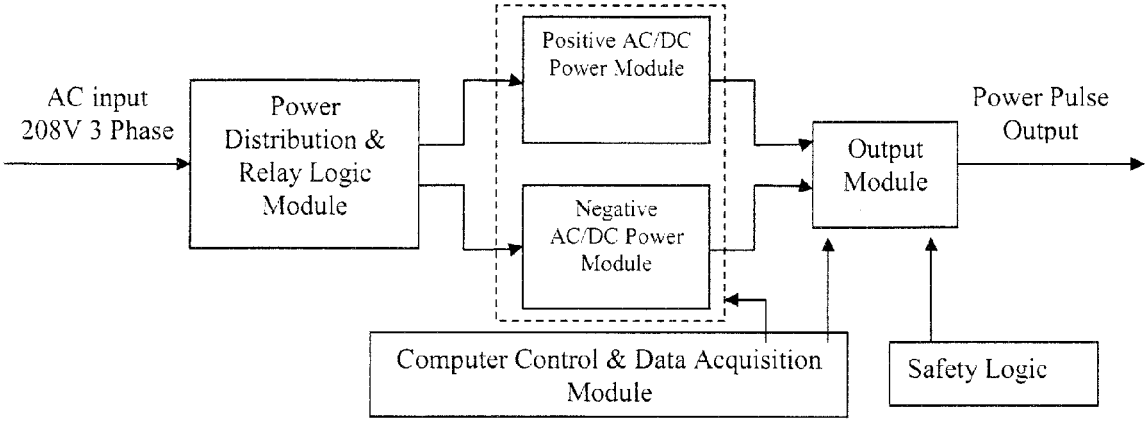
FIG. 1 is a schematic wiring diagram of power distribution and relay logic module.
Figure 2:
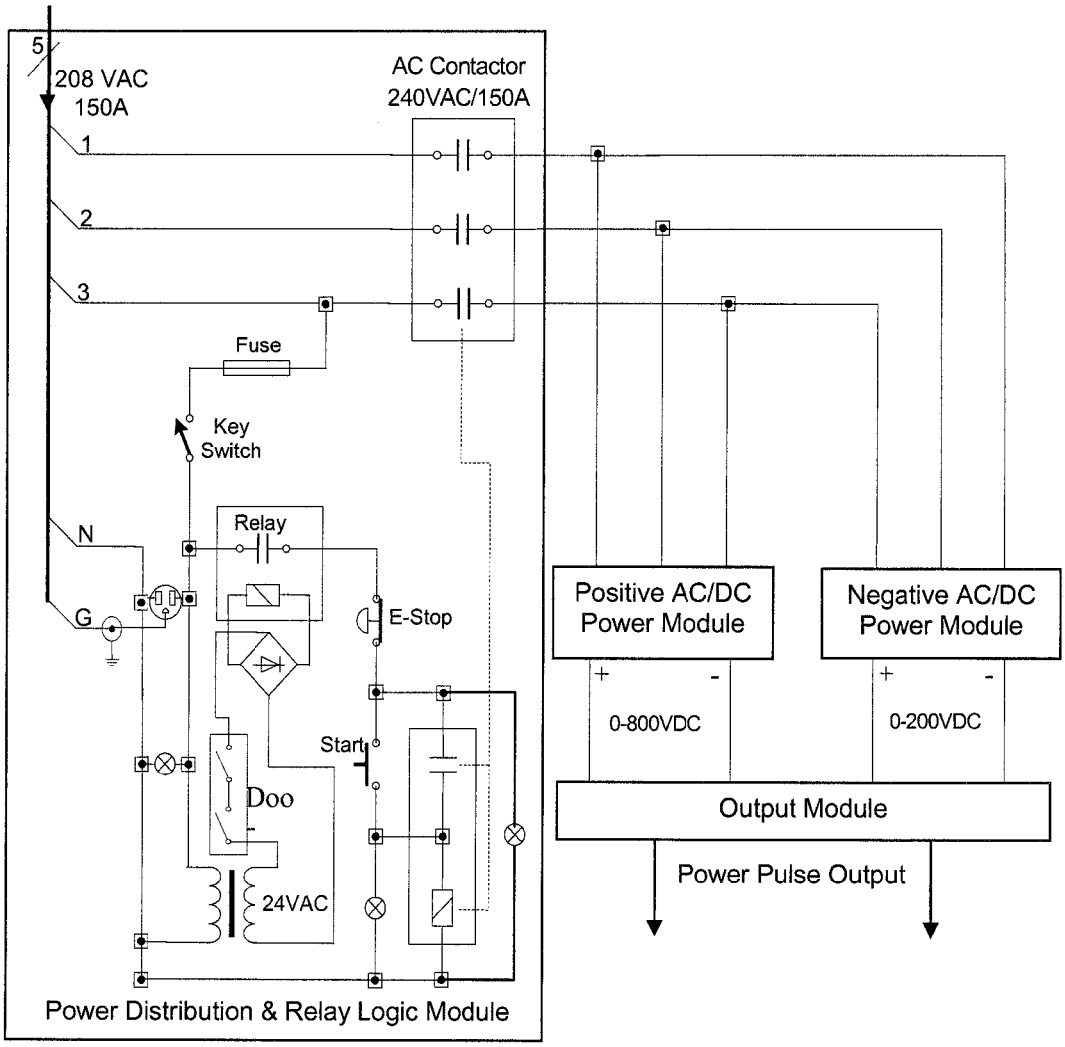
FIG. 2 is a wiring diagram of output module.

The power unit according to the invention includes 5 modules, namely, (i) Power Distribution & Relay Logic Module, (ii) Positive AC/DC Power Module, (iii) Negative AC/DC Power Module, (iv) Output Module, and (v) Computer Control & Data Acquisition Module. The wiring diagram of the Power Distribution & Relay Logic Module is provided in FIG. 1. The wiring diagram of Output Module is illustrated in FIG. 2. The pulsed controller and the IGBT power switches are major parts of the output module.

The positive and negative plus voltage can be provided individually by commercial products, such as Amrel Module SPS800-36 (800V/36 A) as Positive AC/DC Power Module and Amrel Module SPS200-16 (200V/16 A) as Negative AC/DC Power Module. NI USB-621x is used for data acquisition and pulsed output controller.

The positive and negative plus voltage can also be realized with integrated AC/DC modules which have high efficiency, reliability, flexibility and low cost. A TI C2000 microcontroller could be used for data acquisition, output pulse control, and AC/DC power module control. The microcontroller supports a simple button and displayer interface, and a standard communication to the host computer.

Figure 3:
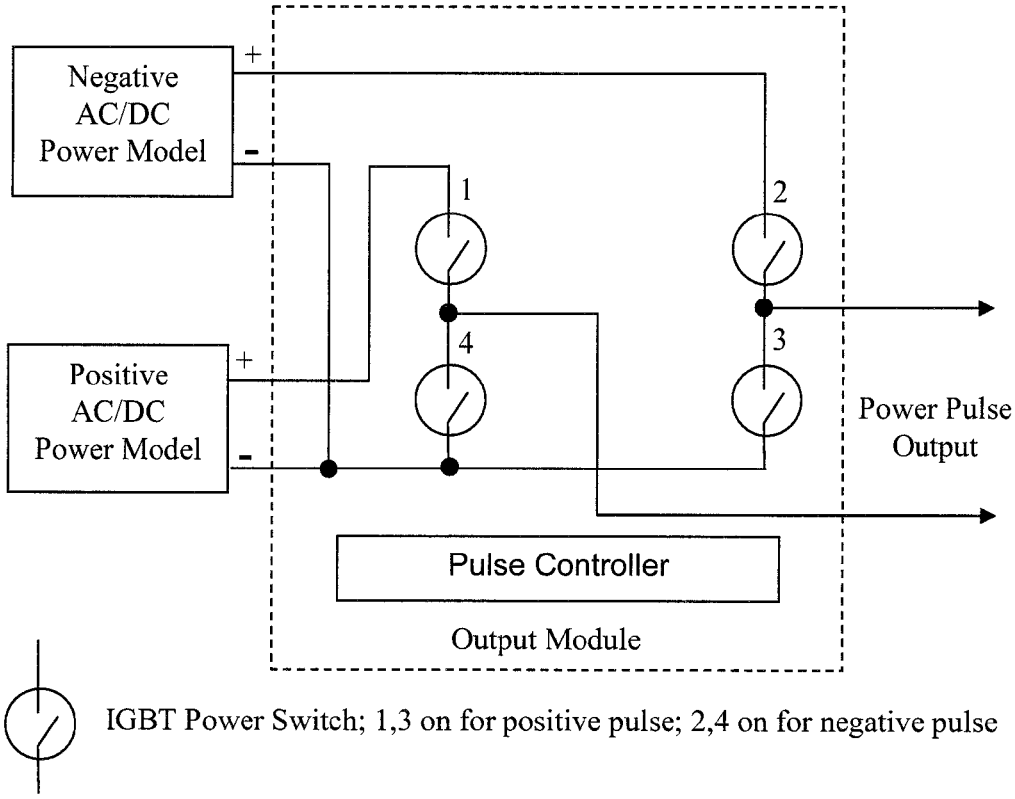
FIG. 3 is a schematic diagram illustrating the pulse output of the plasma electrolytic oxidation power supply unit according to the invention.

Typical (not restricted as listed) features of the novel power unit:

1. Positive plus voltage 0 to 800 volt
2. Negative plus voltage 0 to 200 volt
3. Output plus frequency 30-6000 Hz
4. Positive and Negative plus proportion 1:1 to 20:1
5. Duty cycle 5% to 85%
6. Output power 1 to 300 kW
7. Flexibility in terms of the shape of output waveform
8. Safety limits and protection of both operators and power unit The applications of the power unit described in FIGS. 1 to 3 for providing ceramic coatings have been performed. The following three examples demonstrated the feasibility of the invention to deposit ceramics on different metallic substrates. In summary, titanium oxide, zirconia and aluminum-based coating were successfully prepared on pure titanium, Zircalloy and aluminum alloy substrates, respectively, by a plasma electrolytic oxidation process in $Na_2SiO_3$ aqueous solution. The results of potentiodynamic polarization testing showed that the corrosion-resistant property was obviously improved by forming $TiO_2$ coating compared with that of bare pure titanium; the corrosion potential increased about 0.13 V and the corrosion current density decreased about one order magnitude.

Example 1

Ceramic Coatings on Titanium Substrates

Commercially pure titanium plate (Grade 2, R50400) and aluminum alloy plate (5052-H32) were cut into samples with a size of 50 mm×10 mm×1 mm. Zircoalloy coupons were offered by AECL, Canada, with a size of 25 mm×10 cm×1.3 mm. Prior to plasma electrolytic oxidation (PEO) treatment, the specimens were polished with 400 grit SiC abrasive paper, and degreased with acetone followed by rinsing with distilled water. A home-made pulsed power source with a power of 26.4 kW was used for PEO treatment of the samples. The unit for PEO processing mainly consists of a water-cooled glass electrolyser with stainless steel liner and a high power electrical source. The stainless steel liner also serves as the counter electrode. The electrolyte solution in this study is consisted of 27 g $L^{-1}$ $Na_2SiO_3$ aqueous solution. After the treatment, the coated samples were rinsed with disionized water and dried in air.

Figure 4:
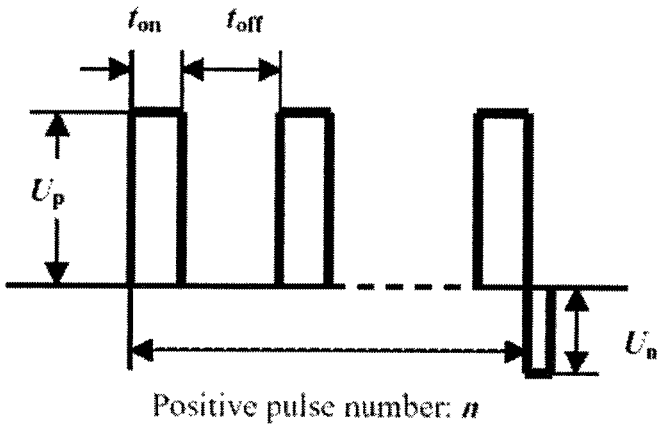
FIG. 4 Illustrates the pulse output of the plasma electrolytic oxidation.

The pulse output of the power supply unit for plasma electrolytic oxidation treatment is schematically shown in FIG. 4. The pulse duty ratio is defined as follows:

$$\text{Duty ratio}(D) = \frac{t_{on}}{t_{on} + t_{off}} \times 100\%. \quad \text{a}$$

where $t_{on}$ is the pulse on-time and $t_{off}$ is the pulse off-time. In this study, the frequency of negative pulse is set the same as that of positive pulse. Other parameters were fixed as follows:

negative pulse duty ratio $D_n$=10%; negative pulse voltage $U_n$=12 V; the number of negative pulse is 1, namely, a cycle of n positive pulse is followed by one negative pulse. For clarity, the duty ratio and positive/negative pulse proportion are hereafter abbreviated as D and R, respectively. An average current density of 0.12 A $cm^{-2}$ was applied.

The phase composition of coatings was examined by X-ray powder diffraction performed on Bruker AXS D8 Advance with Cu $K_\alpha$ radiation. The morphology of the surface and cross-section of coatings was observed by a scanning electron microscope (SEM, Hitachi S-3500N, Japan). The coating thickness was measured using a thickness gauge (CTG-10, Company, U.S.A.) with a minimum resolution of 1 μm. The average thickness of each sample was obtained from 5 times measurements at different positions.

Potentiodynamic polarization measurements were carried out on a Solartron electrochemical workstation in a conventional three-electrode cell, using a saturated calomel electrode (SCE) as the reference electrode, a platinum mesh as a counter electrode, and the coated sample as the working electrode. After the electrochemical testing system was stable, the measurements were carried out in a 3.5 wt. % NaCl solution at 25° C. The scanning rate was 1 mV $s^{-1}$, with a scanning potential range from −0.6 V to +0.6 V versus the open circuit potential (OCP).

Figure 5:
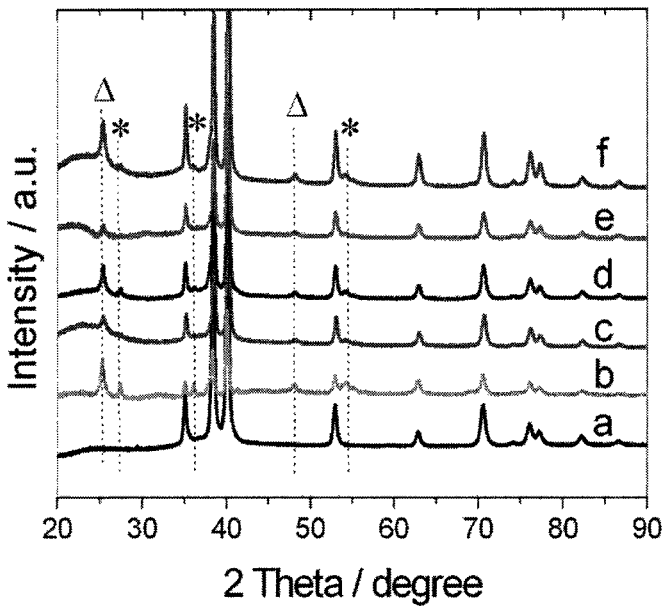
FIG. 5 illustrates XRD patterns of the samples prepared under D=20%, R=3, and at different frequency: (a) bare titanium substrate, (b) 900 Hz, (c) 1800 Hz, (d) 2700 Hz, (e) 3600 Hz, (f) 4500 Hz.

The thickness of coatings measured by a thickness gauge is about 10 μm. The phase structures of these coatings were characterized by XRD. FIG. 5 shows the XRD patterns of the five coatings prepared at different frequencies from 900 Hz to 4500 Hz and bare titanium substrate. The peaks of titanium in curves b-f come from the titanium substrate, which indicated the coating is thinner. Besides the peaks from titanium substrate, it shows that five coatings have a similar phase structure with the main phases of anatase $TiO_2$ (marked with Δ in FIG. 5, JCPDS No. 01-073-1764) plus a little amount of rutile $TiO_2$ (marked with *, JCPDS No. 01-073-1765).

Figures 6A, 6B, 6C, 6D, 6E, 6F:
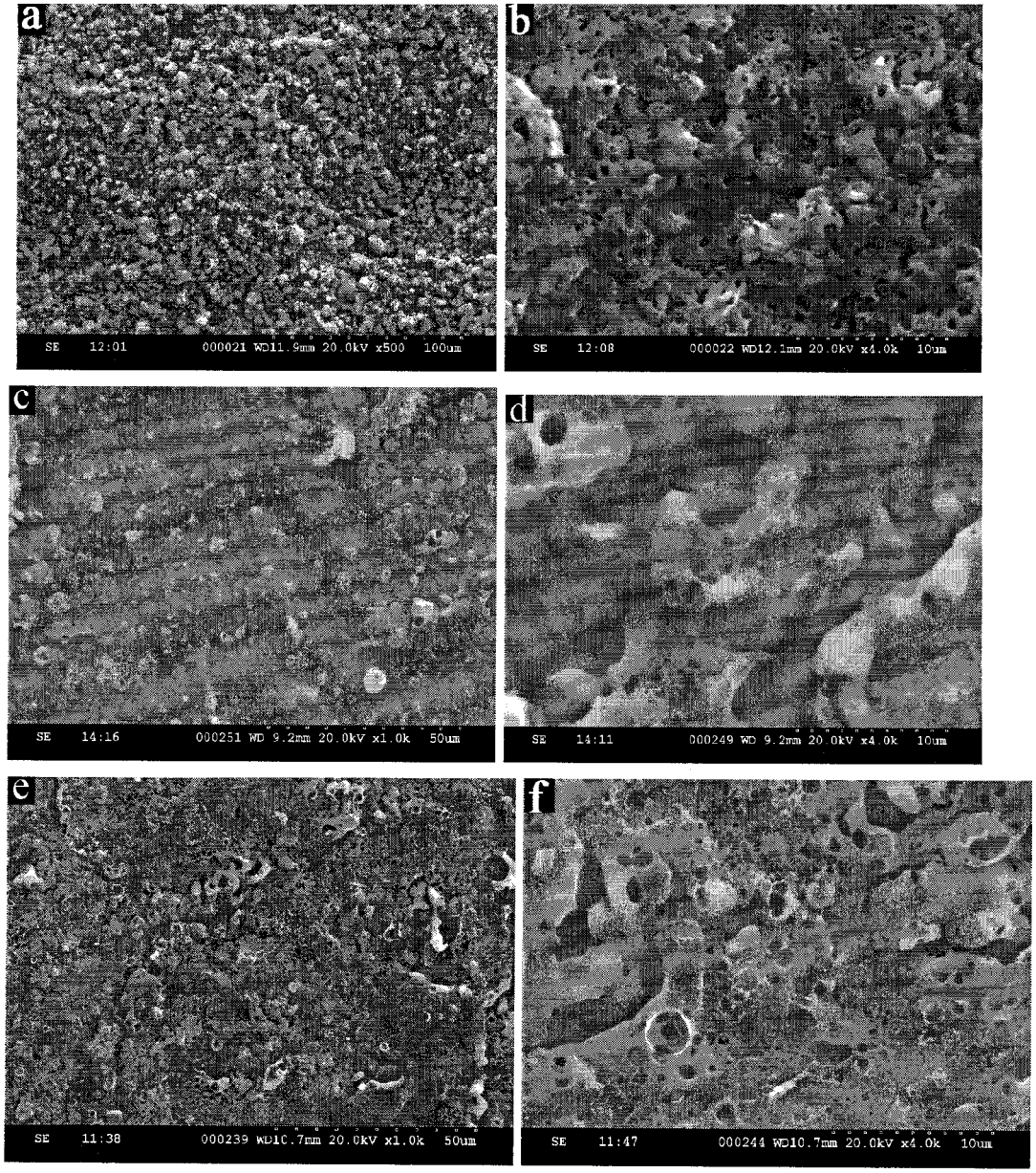
FIG. 6 illustrates surface SEM images of the coatings prepared under D=20%, R=3, and at different frequencies: (a,b) 900 Hz; (c,d) 1800 Hz; (e,f) 2700 Hz; (g,h) 3600 Hz; and (i,j) 4500 Hz.
Figures 6G, 6H, 6I, 6J:
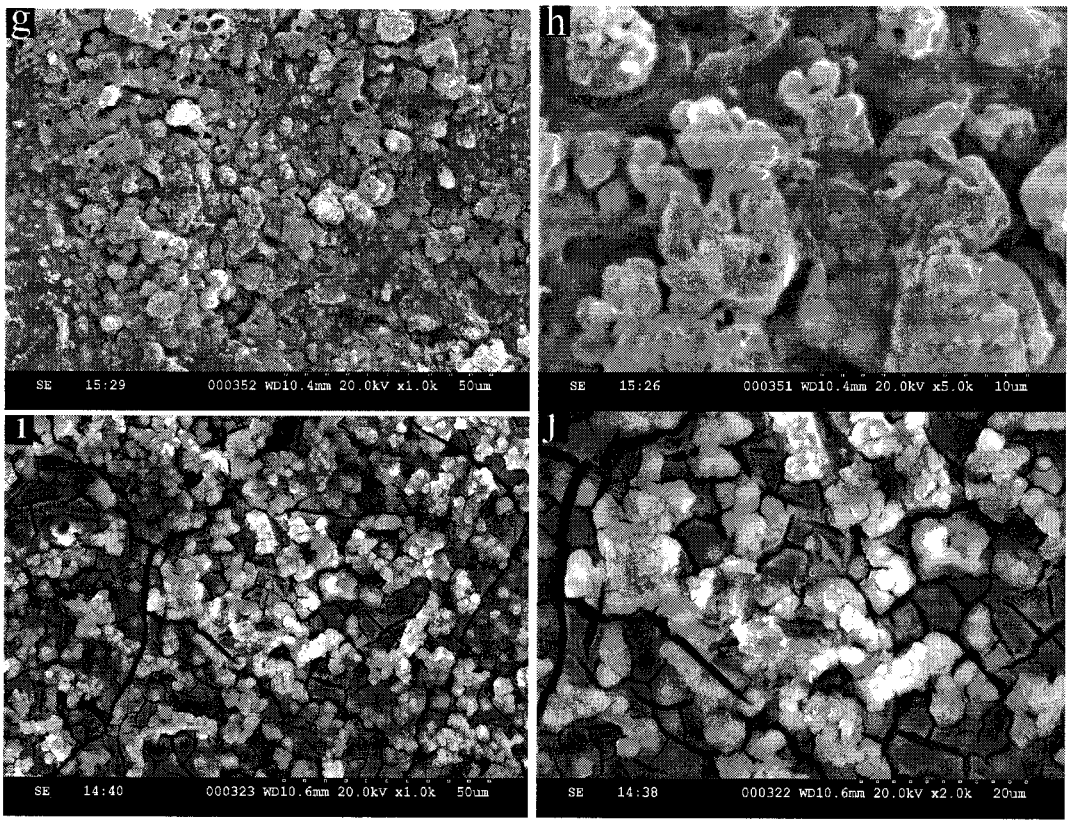

Frequency is a key factor in controlling the surface morphology of the coating. FIG. 6 shows SEM images of the surface morphologies of the prepared $TiO_2$ coatings obtained with D=20%, R=3, and at various frequencies from 900 Hz to 4500 Hz. It showed that the coatings are uniform in the frequency range from 900 to 2700 Hz (FIG. 6*a-f*). When the frequency is increased to 3600 Hz, the grains grow (FIG. 6*g, h*). Upon further increase of the frequency to 4500 Hz, there are many cracks on the surface (FIGS. 6*i* and *j*). This indicates that frequency has a more obvious effect on the PEO process.

Figure 7:
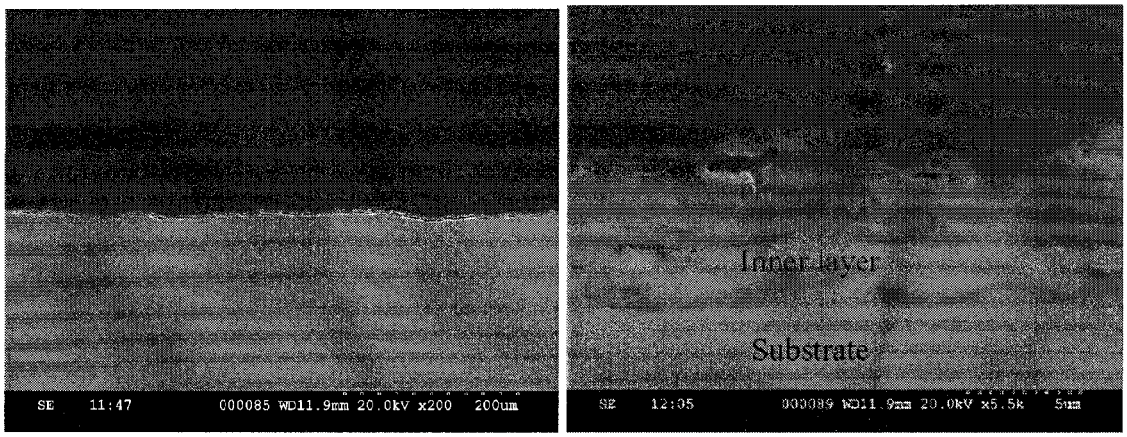
FIG. 7 shows cross-sectional SEM images of the coatings prepared at 900 Hz, D=20%, R=3.
Figure 8:
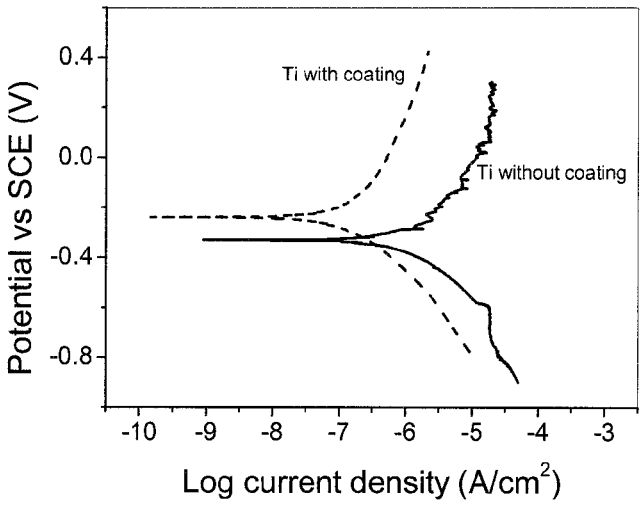
FIG. 8 is a graph illustrating potentiodynamic polarization curves of the titanium substrate and coated sample prepared at 900 Hz, D=20%, and R=3; tested in 3.5% NaC1 solution.

FIG. 7 shows the cross-sectional SEM images of the coating prepared at 900 Hz, D=20%, and R=3. It indicates that the coating is continuous and uniform (FIG. 7*a*). From the high-magnification SEM image, it can be seen that the coating is composed of two layers structure, a porous outer layer and a dense inner layer The potentiodynamic polarisation curves of the coated sample and bare titanium substrate are shown in FIG. 8. It can be seen that the corrosion potential ($E_{corr}$) increases from −0.378 V for bare titanium substrate to −0.251 V for the sample with coating while the corrosion current density ($i_{corr}$) decreases about one order magnitude. From these results, it indicates that the coated samples have better corrosion-resistant property than the bare substrate due to the existence of the ceramic coatings.

Example 2

Ceramic Coatings on Aluminum Substrates

Prior to plasma electrolytic oxidation (PEO) treatment, the Aluminum substrate specimens were polished with 400 grit SiC abrasive paper, and degreased with acetone followed by rinsing with distilled water. A home-made pulsed power source with a power of 26.4 kW was used for PEO treatment of the samples. The unit for PEO processing mainly consists of a water-cooled glass electrolyser with stainless steel liner and a high power electrical source. The stainless steel liner also serves as the counter electrode. The electrolyte solution in this study is consisted of 27 g $L^{-1}$ $Na_2SiO_3$ aqueous solution. After the treatment, the coated samples were rinsed with disionized water and dried in air.

Figure 9:
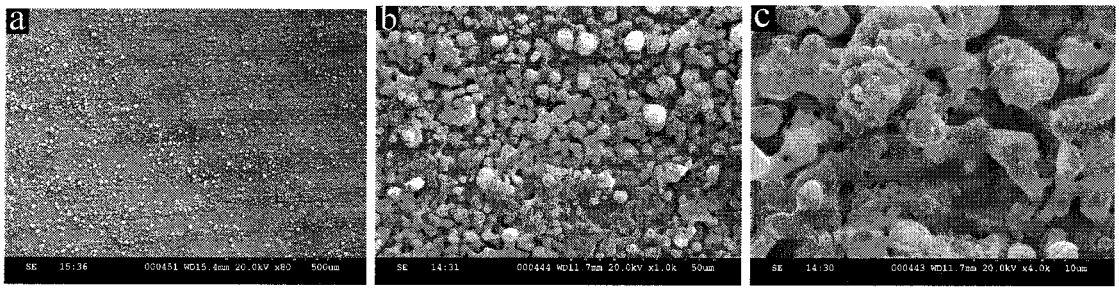
FIG. 9 illustrates surface SEM images of the coatings on aluminum alloy substrate prepared at 2700 Hz, D=20%, and R=3.
Figure 10:
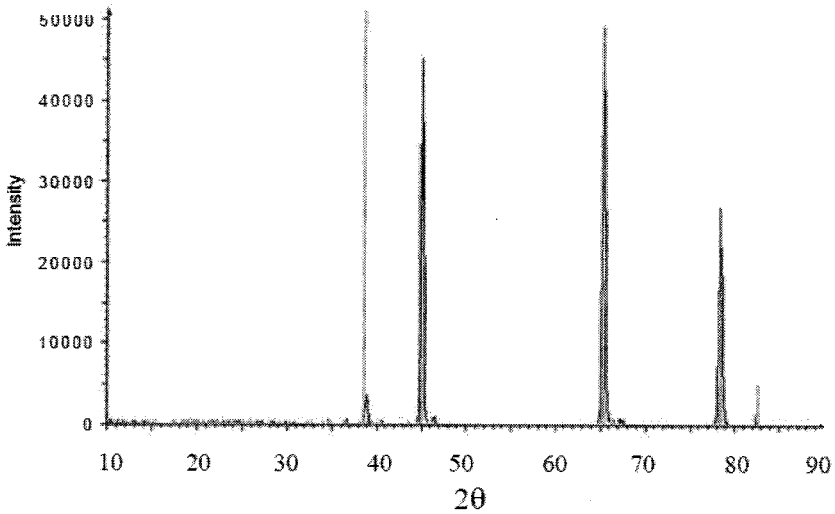
FIG. 10 is a graph illustrating an XRD pattern of the coating deposited on aluminum substrate.

FIG. 9 shows SEM images of the surface of aluminum-based ceramic coating prepared at 2700 Hz, D=20%, and R=3. It shows that the coating is relatively uniform and no cracks are found on the surface. FIG. 10 shows the XRD patterns of the coating on aluminum alloy substrate. It indicated that the coating consists of aluminum silicon and aluminum oxide phases.

Example 3

Ceramic Coatings on Zirconium-based Alloy

Zircoalloy coupons were offered by AECL, Canada, with a size of 25 mm×10 cm×1.3 mm. Prior to plasma electrolytic oxidation (PEO) treatment, the specimens were polished with 400 grit SiC abrasive paper, and degreased with acetone followed by rinsing with distilled water. A home-made pulsed power source with a power of 26.4 kW was used for PEO treatment of the samples. The unit for PEO processing mainly consists of a water-cooled glass electrolyser with stainless steel liner and a high power electrical source. The stainless steel liner also serves as the counter electrode. The electrolyte solution in this study is consisted of 27 g $L^{-1}$ $Na_2SiO_3$ aqueous solution. After the treatment, the coated samples were rinsed with disionized water and dried in air.

Figure 11:
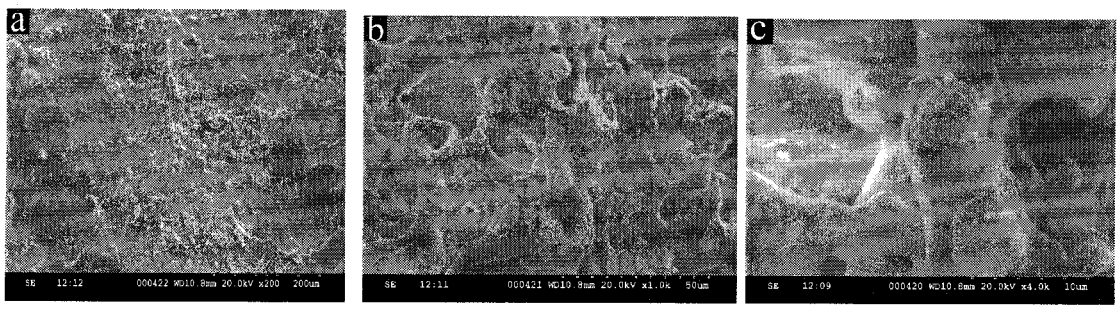
FIG. 11 shows surface SEM images of the coatings on Zircalloy substrate prepared at 2700 Hz, D=20%, and R=3.
Figure 12:
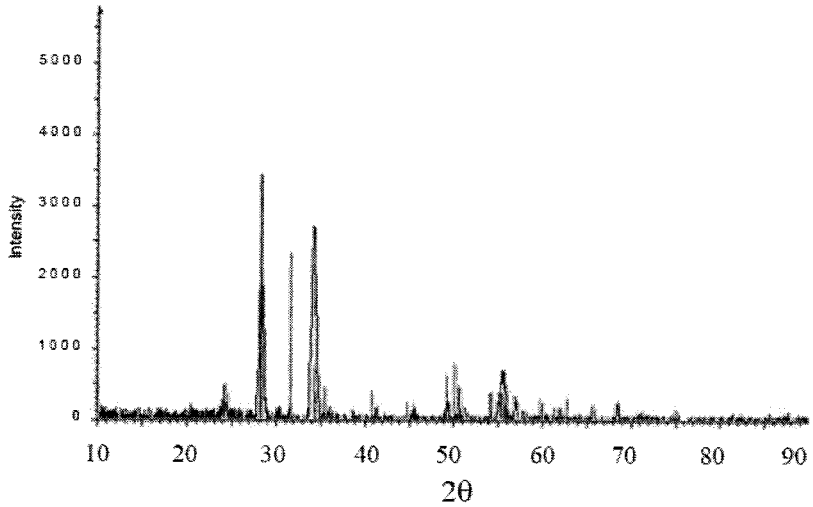
FIG. 12 is a graph illustrating an XRD pattern of the coating deposited on Zircalloy substrate.

FIG. 11 shows SEM images of the surface of $ZrO_2$ coating prepared at 2700 Hz, D=20%, and R=3. From the SEM images, the coating is relatively uniform, however, it should be pointed out that the coating was peeled off locally during the PEO treatment even using the lowest current of the present power unit. Therefore, the current range of the power unit need to be changed for achieving better $ZrO_2$ coating. FIG. 12 shows the XRD patterns of the coating on Zircalloy substrate. It indicated that the coating is baddeleyite-type $ZrO_2$ with a monoclinic phase.

The invention claimed is:

1. A pulsed power supply for plasma electrolytic deposition (PED) for generating pulsed direct current for controlled interruption of the arcing process of PED, comprising a power distribution and relay logic (PDRL) module;

a positive AC/DC (alternating current/direct current) power module;

a negative AC/DC power module;

a power pulse output module; and a computer control and data acquisition module, wherein the power pulse output module further comprises a pulse controller and an insulated-gate bipolar transistor (IGBT) power switch, and wherein the PDRL module is operatively coupled to both the positive and negative AC/DC power modules and the respective positive and negative power modules are then operatively coupled to both the power pulse output module and the computer control and data acquisition module, and wherein the computer control and data acquisition module controls both the respective positive and negative power modules and the power pulse output module to generate pulsed DC for controlled interruption of the arcing process.

2. The pulsed power supply according to claim 1, wherein the computer control and data acquisition module is embodied in a microcontroller.

3. The pulsed power supply according to claim 2, wherein the positive AC/DC power module converts AC pulses received from the PDRL into positive DC pulses ranging from 0 to 800 volts direct current (VDC).

4. The pulsed power supply according to claim 3, wherein the positive AC/DC power module converts the AC pulses received from the PDRL into negative DC pulses ranging from 0 to 200 volts direct current (VDC).

5. The pulsed power supply according to claim 4, wherein the pulse controller then enables the IGBT device to switch between outputting positive and negative DC pulses to the power pulse output module.

6. The pulsed power supply according to claim 5, wherein the power pulse output module utilizes pulse width modulation (PWM) with the IGBT device to switch the supply pulses at setup frequencies of 30 to 6000 Hz.

7. The pulse power supply according to claim 6, wherein the power output is 1 to 300 kW.

* * * * *